US009956794B2

(12) United States Patent
Mitsuo

(10) Patent No.: US 9,956,794 B2
(45) Date of Patent: May 1, 2018

(54) PRINTING APPARATUS

(71) Applicant: SEIKO EPSON CORPORATION, Tokyo (JP)

(72) Inventor: Noritaka Mitsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/399,039

(22) Filed: Jan. 5, 2017

(65) Prior Publication Data

US 2017/0197441 A1 Jul. 13, 2017

(30) Foreign Application Priority Data

Jan. 8, 2016 (JP) ..... 2016-002313

(51) Int. Cl.

| | |
|---|---|
| ***B41J 11/66*** | (2006.01) |
| ***B41J 11/70*** | (2006.01) |
| ***B41J 3/407*** | (2006.01) |
| ***B41J 11/00*** | (2006.01) |
| *B41J 15/04* | (2006.01) |
| *D06C 27/00* | (2006.01) |

(52) U.S. Cl.

CPC ..... *B41J 11/70* (2013.01); *B41J 3/4078* (2013.01); *B41J 11/0015* (2013.01); *B41J 15/048* (2013.01); *D06C 27/00* (2013.01)

(58) Field of Classification Search

CPC . B41J 11/70; B41J 11/706; B41J 11/66; B41J 11/666; B41J 11/007; B41J 25/308; B41J 25/304; B41J 2002/16591; B41J 13/08; B41J 15/048

See application file for complete search history.

(56) References Cited

U.S. PATENT DOCUMENTS

| | | | | |
|---|---|---|---|---|
| 3,187,782 | A | 6/1965 | Gattoni | |
| 6,030,076 | A | 2/2000 | Yoshimura et al. | |
| 2003/0206211 | A1* | 11/2003 | Baron | B41J 3/50 347/37 |
| 2005/0174412 | A1* | 8/2005 | Codos | B41J 2/01 347/102 |
| 2010/0119282 | A1* | 5/2010 | Olsen | B41J 3/407 400/621 |

(Continued)

FOREIGN PATENT DOCUMENTS

| | | | |
|---|---|---|---|
| EP | 2 774 767 | A1 | 9/2014 |
| EP | 2 787 119 | A1 | 10/2014 |

(Continued)

OTHER PUBLICATIONS

European Search Report for Application No. 17150434.3 dated Jun. 28, 2017.

*Primary Examiner* — Geoffrey Mruk
*Assistant Examiner* — Scott A Richmond
(74) *Attorney, Agent, or Firm* — Workman Nydegger

(57) ABSTRACT

A printing apparatus includes a discharging head which discharges liquid on a printing medium mounted on an endless belt; a medium transport portion as a transport unit which transports the printing medium; an input device as an input unit to which printing condition is input; and a fluff cutter portion which is provided on an upstream side of the discharging head in the transport direction and which cuts fluff of the printing medium in a predetermined height according to the printing condition.

6 Claims, 7 Drawing Sheets

(56) References Cited

U.S. PATENT DOCUMENTS

| | | | | |
|---|---|---|---|---|
| 2011/0123245 | A1* | 5/2011 | Gocho | B26D 5/28<br>400/621 |
| 2013/0278693 | A1* | 10/2013 | Bellisario | B41J 29/17<br>347/104 |

FOREIGN PATENT DOCUMENTS

| | | |
|---|---|---|
| JP | H06 128875 A | 5/1994 |
| JP | 2003-027351 | 1/2003 |
| JP | 2007-224436 | 9/2007 |

* cited by examiner

| PRINTING MEDIUM | ROTATIONAL SPEED |
|---|---|
| WOOL | HIGH SPEED |
| COTTON | MEDIUM SPEED |
| POLYESTER | LOW SPEED |

PRINTING APPARATUS

BACKGROUND

1. Technical Field

The present invention relates to a printing apparatus.

2. Related Art

In the related art, an ink jet type of a printing apparatus is used which prints an image or the like on a printing medium by discharging liquid such as ink in droplet form from a discharging head having a nozzle toward a surface of the printing medium. It is desirable to process fluff just before printing so that reduction of printing quality by contact between the fluff and the discharging head with each other or attachment of a released fluff to the discharging head is prevented in advance, in a case where fabric of which the fluff is generated on a surface, or the like is used as the printing medium of the printing apparatus. A method for processing the fluff is disclosed in JP-A-2007-224436, for example, which is a method for thermally fusing a fluff layer by radiating a laser beam to the fluff layer.

A fluff processing described in JP-A-2007-224436 requires a laser irradiating device in order to irradiate fluff with a laser beam. However, providing the laser irradiating device on a printing apparatus is difficult due to increase in cost and safety issues of the apparatus. In addition, there is a problem that images are unclear by landing deviation of droplets being increased, in a case where printing is performed in a state a discharging head is raised with respect to a printing medium so that the fluff and the discharging head are not in contact with each other. Therefore, it is still difficult to provide the printing apparatus which forms images having excellent printing quality on the printing medium on which the fluff is generated.

SUMMARY

The invention can be realized in the following forms or application examples.

Application Example 1

According to this application example, there is provided a printing apparatus including a discharging head which discharges liquid on a printing medium mounted on an endless belt; a transport unit which transports the printing medium; an input unit to which printing condition is input; and a fluff cutter portion which is provided on an upstream side of the discharging head in the transport direction and which cuts fluff of the printing medium in a predetermined height according to the printing condition.

According to the present application example, the printing apparatus includes the fluff cutter portion which cuts the fluff of the printing medium. Opportunity of the contact between the discharging head and the printing medium with each other is reduced and defects such as nozzle missing and landing deviation which are generated by contact between the discharging head and the fluff with each other are less likely to be generated, by the fluff of the printing medium transported by a transport unit being cut in a predetermined height by the fluff cutter portion, according to the printing condition input to the input unit by a user. In addition, the discharging head can be set low, by cutting the fluff. Therefore, images having excellent printing quality are formed on the printing medium on which the fluff is generated. Therefore, the printing apparatus which improves the printing quality can be provided.

Application Example 2

In the printing apparatus according to the application example, it is preferable that the printing condition include a distance between the endless belt and the discharging head and that the printing apparatus include a moving unit which changes a distance between the fluff cutter portion and the printing medium according to the distance.

According to the application example, the printing apparatus can cut the fluff of the printing medium in a predetermined height, by changing a distance between the fluff cutter portion and the printing medium according to the distance between the endless belt and the discharging head which is input by the user, by including the moving unit which changes the distance between the fluff cutter portion and the printing medium.

Application Example 3

In the printing apparatus according to the application example, it is preferable that the printing condition include a type of the printing medium and that the fluff cutter portion include a rotating blade of which rotational speed is changed according to the type.

According to the application example, the fluff of the different type of the printing medium can be suitably cut, by fluff cutter portion including the rotating blade of which rotational speed is changed according to the type of the printing medium, although the amount (density) of the fluff of the printing medium is different according to the type of the printing medium.

Application Example 4

In the printing apparatus according to the application example, it is preferable that the fluff cutter portion include an absorbing portion which absorbs the cut fluff.

According to the application example, the fluff which is cut by the fluff cutter portion is prevented from being scattered in the inside of the printing apparatus, by the fluff cutter portion including the absorbing portion which absorbs the cut fluff.

Application Example 5

It is preferable that the printing apparatus according to the application example further include a projecting portion which lifts the printing medium to a position facing the fluff cutter portion.

According to the application example, the printing apparatus can suitably cut the fluff, by including the projecting portion which lifts the printing medium.

Application Example 6

It is preferable that the printing apparatus according to the application example further include a notifying portion which notifies an alarm according to the input printing condition.

According to the application example, the printing apparatus can prevent texture of the printing medium from being damaged by the cutting of the fluff or printing of which the image quality is reduced from being performed, in advance, by including the notifying portion which notifies the alarm in a case where a relationship between the distance between the printing medium and the discharging head and the type of the printing medium is inappropriate, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described, with reference to drawings. Scales of each layer and each member are different from those of actual layers and actual members since each layer and each member have recognizable extent of sizes in the following drawings.

In addition, X axis, Y axis, and Z axis are illustrated as three axes which are perpendicular to each other for convenience of explanation in FIG. 1 to FIG. 3, FIG. 7 and FIG. 8. A distal end side of an arrow which illustrates an axial direction is referred to as "+side" and a proximal end side thereof is referred to as "−side". In addition, a direction which is parallel to X axis is referred to as "X axis direction", a direction which is parallel to Y axis is referred to as "Y axis direction", and a direction which is parallel to Z axis is referred to as "Z axis direction", in the following.

Embodiment 1

Schematic Configuration of Printing Apparatus

Figure 1:
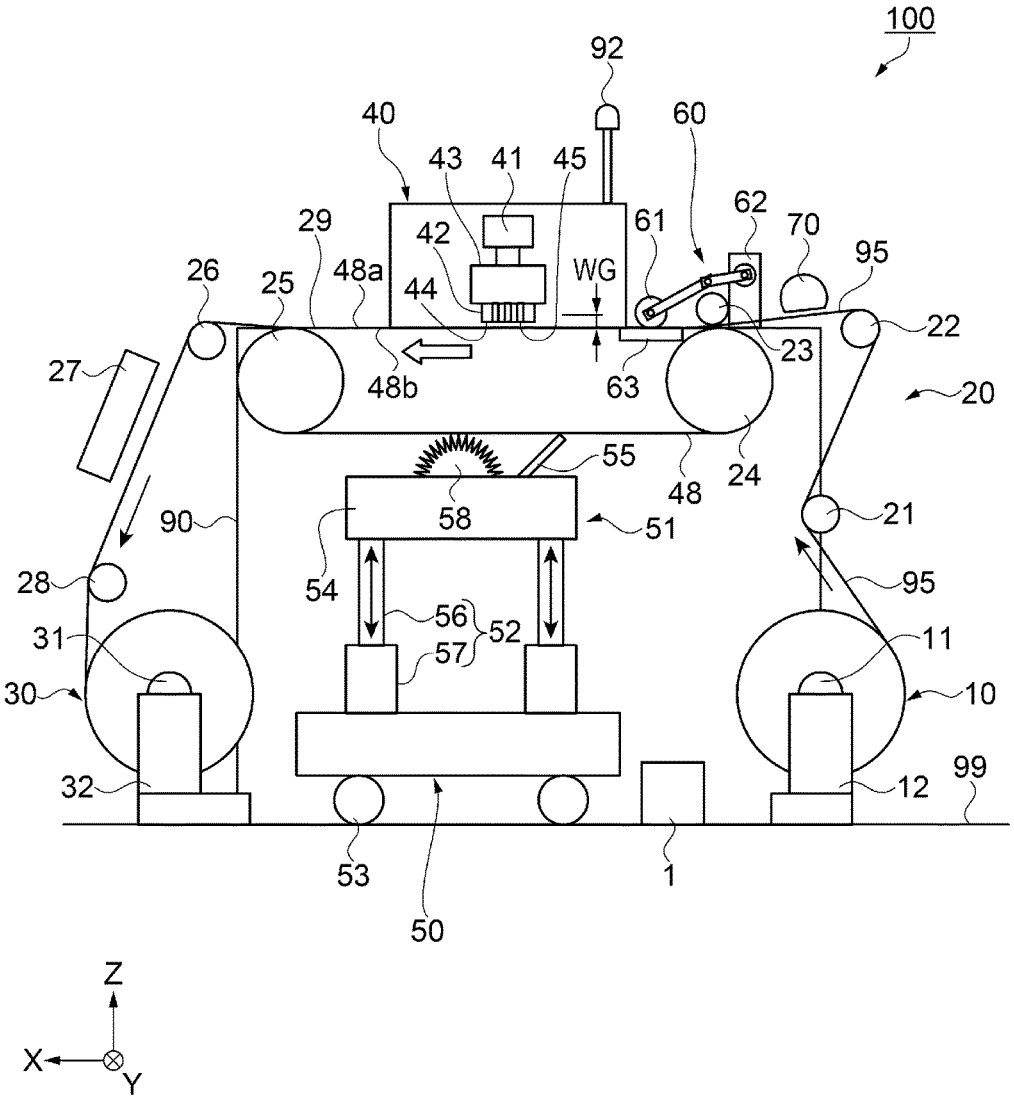
FIG. 1 is a schematic view illustrating overall configuration of a printing apparatus according to Embodiment 1.

FIG. 1 is a schematic view illustrating overall configuration of a printing apparatus according to Embodiment 1. First, with reference to FIG. 1, the schematic configuration of the printing apparatus 100 according to the embodiment will be described. In the embodiment, an ink jet type of a printing apparatus 100 which performs printing on a printing medium 95 by forming an image or the like on the printing medium 95 will be described.

As illustrated in FIG. 1, the printing apparatus 100 includes a medium transport portion 20, a fluff cutter portion 70, a medium close contacting portion 60, a printing portion 40, a drying unit 27, a cleaning unit 50, and a notifying portion 92. The printing apparatus 100 includes a control portion 1 which controls each portion described above. Each portion of the printing apparatus 100 is attached to a frame portion 90.

The medium transport portion 20 is a transport unit which transports the printing medium 95 in a transport direction (+X axis direction in a printing portion 40). The medium transport portion 20 includes a medium supplying portion 10, transport rollers 21, 22, and 23, an endless belt 48, a belt rotating roller 24, a belt driving roller 25, transport rollers 26 and 28, and a medium collecting portion 30. First, a transport path of the printing medium 95 leading from the medium supplying portion 10 to the medium collecting portion 30 will be described.

The medium supplying portion 10 supplies the printing medium 95 on which an image is formed to the printing portion 40 side. Fabric such as cotton, wool, and polyester is used as the printing medium 95, as an example. The medium supplying portion 10 includes a supplying shaft portion 11 and a bearing portion 12. The supplying shaft portion 11 has a cylindrical shape or a columnar shape and is provided to be rotatable in a circumferential direction. The printing medium 95 having a strip shape is wound into a roll shape in the supplying shaft portion 11. The supplying shaft portion 11 is detachably attached to the bearing portion 12. Therefore, the printing medium 95 in a state of being wound to the supplying shaft portion 11 in advance can be attached to the bearing portion 12 along with the supplying shaft portion 11.

The bearing portion 12 supports to be rotatable both ends of the supplying shaft portion 11 in an axial direction. The medium supplying portion 10 includes a rotation driving portion (not illustrated) which rotates and drives the supplying shaft portion 11. The rotation driving portion rotates the supplying shaft portion 11 in a direction in which the printing medium 95 is delivered. An operation of the rotation driving portion is controlled by the control portion 1. The transport rollers 21, 22, and 23 relay the printing medium 95 from the medium supplying portion 10 to the endless belt 48.

The endless belt 48, the belt rotating roller 24 and the belt driving roller 25 transport the printing medium 95 in the transport direction (+X axial direction) in the printing portion 40. Specifically, the endless belt 48 is formed in an endless shape by connecting both ends of a belt having a strip shape with each other and is hung on the belt rotating roller 24 and the belt driving roller 25. The endless belt 48 is held in a state where a predetermined tension is applied so that a portion between the belt rotating roller 24 and the belt driving roller 25 is parallel to a floor surface 99. An adhesive layer 29 which adheres the printing medium 95 is provided in a surface 48*a* (supporting surface) of the endless belt 48. The endless belt 48 supports (holds) the printing medium 95 which is supplied from the transport roller 22 and is in close contact with the adhesive layer 29 with the medium close contacting portion 60 to be described below. Accordingly, fabric, or the like which has elasticity can be treated as the printing medium 95.

The belt rotating roller 24 and the belt driving roller 25 support an inner peripheral surface 48*b* of the endless belt 48. A supporting portion which supports the endless belt 48 is configured to be provided between the belt rotating roller 24 and the belt driving roller 25.

The belt driving roller 25 includes a motor (not illustrated) which rotates and drives the belt driving roller 25. When the belt driving roller 25 rotates and drives, the endless belt 48 rotates according to the rotation of the belt driving roller 25, and then the belt rotating roller 24 rotates by the rotation of the endless belt 48. The printing medium 95 which is supported to the endless belt 48 is transported in the predetermined transport direction (+X axial direction) by the rotation of the endless belt 48 and thus an image is formed on the printing medium 95 at the printing portion 40 to be described below.

The printing medium 95 is supported on a side (+Z axis side) in which the surface 48*a* of the endless belt 48 faces the printing portion 40 and the printing medium 95 is transported from the belt rotating roller 24 side to the belt driving roller 25 side along with the endless belt 48. In addition, only the endless belt 48 is moved from the belt driving roller 25 side to the belt rotating roller 24 side in a side (−Z axis side) in which the surface 48*a* of the endless belt 48 faces the cleaning unit 50. The endless belt 48 is described as being provided with the adhesive layer 29 which is in close contact with the printing medium 95. However, it is not limited to this. For example, a transport belt may be an electrostatic adsorption type of an endless belt which absorbs the medium to the belt by static electricity.

The transport roller 26 peels off the printing medium 95 on which an image is formed from the adhesive layer 29 of the endless belt 48. The transport rollers 26 and 28 relay the printing medium 95 from the endless belt 48 to the medium collecting portion 30.

The medium collecting portion 30 collects the printing medium 95 which is transported by the medium transport portion 20. The medium collecting portion 30 includes a winding shaft portion 31 and a bearing portion 32. The winding shaft portion 31 has a cylindrical shape or a columnar shape and is provided to be rotatable in a circumferential direction. The printing medium 95 having a strip shape is wound into a roll shape in the winding shaft portion 31. The winding shaft portion 31 is detachably attached to the bearing portion 32. Therefore, the printing medium 95 in a state of being wound to the winding shaft portion 31 is removed along with the winding shaft portion 31.

The bearing portion 32 supports to be rotatable both ends of the winding shaft portion 31 in an axial direction. The medium collecting portion 30 includes a rotation driving portion (not illustrated) which rotates and drives the winding shaft portion 31. The rotation driving portion rotates the winding shaft portion 31 in a direction in which the printing medium 95 is wound. An operation of the rotation driving portion is controlled by the control portion 1.

Next, each portion which is provided along the medium transport portion 20 will be described.

The fluff cutter portion 70 cuts fluff of the printing medium 95 in a predetermined height. The fluff cutter portion 70 is provided between the transport roller 22 and the transport roller 23 which is disposed on an upstream of a discharging head 42 to be described below in the transport direction. Configuration of the fluff cutter portion 70 will be described in detail later.

The medium close contacting portion 60 is in close contact between the printing medium 95 and the endless belt 48 with each other. The medium close contacting portion 60 is positioned on a downstream side (+X axis side) of the fluff cutter portion 70 and is provided on an upstream (−X axis side) of the printing portion 40 with respect to the transport direction of the printing medium 95. The medium close contacting portion 60 includes a pressing roller 61, a pressing roller driving portion 62 and a roller supporting portion 63. The pressing roller 61 has a cylindrical shape or a columnar shape and is provided to be rotatable in a circumferential direction. The pressing roller 61 is disposes to be intersected between an axial direction thereof and the transport direction with each other in order to rotate in a direction along the transport direction. The roller supporting portion 63 is provided on the inner peripheral surface 48*b* of the endless belt 48 in a state of facing the pressing roller 61 with the endless belt 48 being inserted between the pressing roller 61 and the roller supporting portion 63.

The pressing roller driving portion 62 moves the pressing roller 61 in the transport direction (+X axis direction) and in a direction (−X axis direction) opposite to the transport direction while pressing the pressing roller 61 in a lower side of the vertical direction (−Z axis direction). The printing medium 95 which is overlapped with the endless belt 48 by the transport roller 23 is pressed against the endless belt 48 between the pressing roller 61 and the roller supporting portion 63. Accordingly, the printing medium 95 can be reliably adhered to the adhesive layer 29 which is provided on the surface 48*a* of the endless belt 48 and can prevent the printing medium 95 from being lifted from the endless belt 48.

The printing portion 40 is disposed on the upper side (+Z axis side) with respect to a disposition position of the endless belt 48. The printing portion 40 includes the discharging head 42 which discharges ink as an example of liquid in droplet form on the printing medium 95 disposed on the endless belt 48, a carriage 43 on which the discharging head 42 is mounted, and a carriage moving portion 41 which moves the carriage 43 in a width direction (Y axis direction) of the printing medium 95 which is intersected with the transport direction. A nozzle plate 44 on which a plurality of nozzle rows 45 are formed is provided on the discharging head 42. For example, four nozzle rows 45 are formed on the nozzle plate 44. Ink having a different color (for example, cyan: C, magenta: M, yellow: Y, black: K) is discharged per each nozzle row 45. The nozzle plate 44 faces the printing medium 95 which is transported by the endless belt 48.

The carriage moving portion 41 moves the discharging head 42 in a direction (the width direction (Y axis direction) of the printing medium 95) which is intersected with the transport direction of the printing medium 95. The carriage 43 is configured to be supported on a guide rail (not illustrated) which is disposed along Y axis direction and to be capable of reciprocating in the ±Y axis direction by the carriage moving portion 41. Mechanism of a combination of a ball screw and a ball nut, a linear guide mechanism, or the like can be adapted as a mechanism of the carriage moving portion 41, for example.

Further, a motor (not illustrated) as a power source for moving the carriage 43 along Y axis direction is provided in the carriage moving portion 41. When the motor is driven by the control of the control portion 1, the discharging head 42 reciprocates along in the Y axis direction along with the carriage 43. As the discharging head 42, A serial-head type which discharges ink while moving in the width direction (±Y axis direction) of the printing medium 95 which is mounted on the movable carriage is included as an example in the embodiment. However, as the discharging head 42, a line-head type which is disposed to extend in the width direction (Y axis direction) of the printing medium 95 and be fixed may be included.

The drying unit 27 is provided between the transport roller 26 and the transport roller 28. The drying unit 27 dries ink which is discharged on the printing medium 95 and an IR heater is included in the drying unit 27, for example and ink which is discharged on the printing medium 95 can be dried in a short time by driving the IR heater. Accordingly, the printing medium 95 having a strip shape on which an image or the like is formed can be wound around the winding shaft portion 31.

The cleaning unit 50 is disposed between the belt rotating roller 24 and the belt driving roller 25 in the X axis direction. The cleaning unit 50 cleans the surface 48*a* of the endless belt 48. The cleaning unit 50 includes a cleaning portion 51, a pressing portion 52 and a moving portion 53. The moving portion 53 is fixed to a predetermined position by integrally moving the cleaning unit 50 along the floor surface 99.

The pressing portion 52 is a lifting device which is configured as an air cylinder 56 and a ball bushing 57, for example and the cleaning portion 51 which is provided on the upper portion of the pressing portion 52 is in contact with the surface 48*a* of the endless belt 48. The cleaning portion 51 cleans the surface 48*a* (supporting surface) of the endless belt 48 which is hung in a state where a predetermined tension is applied between the belt rotating roller 24 and the belt driving roller 25 from the lower side (−Z axis direction).

The cleaning portion 51 includes a cleaning tank 54, a cleaning roller 58 and a plate 55. The cleaning tank 54 is a tank which stores a cleaning liquid used in cleaning of ink or foreign material attached to the surface 48*a* of the endless belt 48 and the cleaning roller 58 and the plate 55 are provided on an inside side of the cleaning tank 54. As the cleaning liquid, for example, water or water-soluble solvent (such as alcohol aqueous solution) can be used and a surfactant and an antifoaming agent may be added, if necessary.

When the cleaning roller 58 is rotated, a cleaning liquid is supplied to the surface 48*a* of the endless belt 48 and the cleaning roller 58 and the endless belt 48 slides. Accordingly, ink or fiber of fabric as the printing medium 95 attached to the endless belt 48 is removed by the cleaning roller 58.

The plate 55 can be made of flexible material such as silicon rubber, for example. The plate 55 is provided on a downstream side of the cleaning roller 58 in the transport direction of the endless belt 48. The cleaning liquid remaining on the surface 48*a* of the endless belt 48 is removed by the endless belt 48 and the plate 55 slides.

The printing apparatus 100 includes the notifying portion 92 which notifies alarm. The notifying portion 92 according to the embodiment is a so-called Patlite (registered trademark) and notifies a state of the printing apparatus 100 by color, blinking pattern, or the like by control of the control portion 1. The notifying portion is a display device which is configured by a liquid crystal panel and may display notification content in letters or figures.

Configuration of Fluff Cutter Portion

Next, configuration of the fluff cutter portion will be described.

Figure 2:
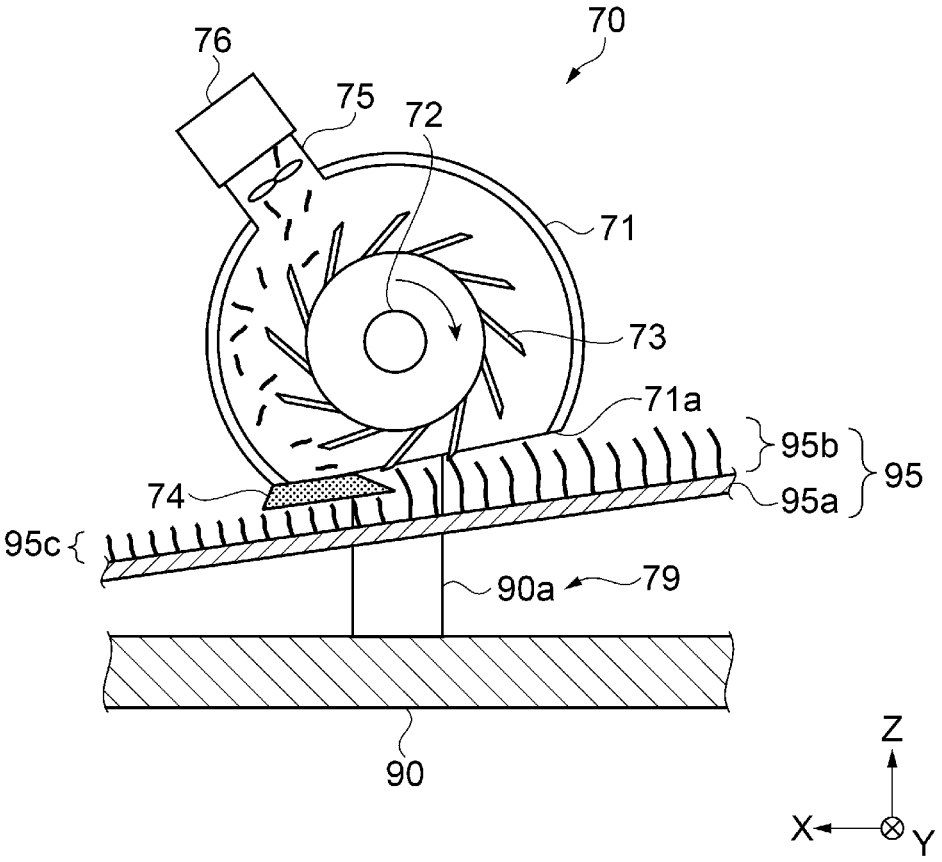
FIG. 2 is a sectional view illustrating configuration of an inside portion of a fluff cutter portion.
Figure 3:
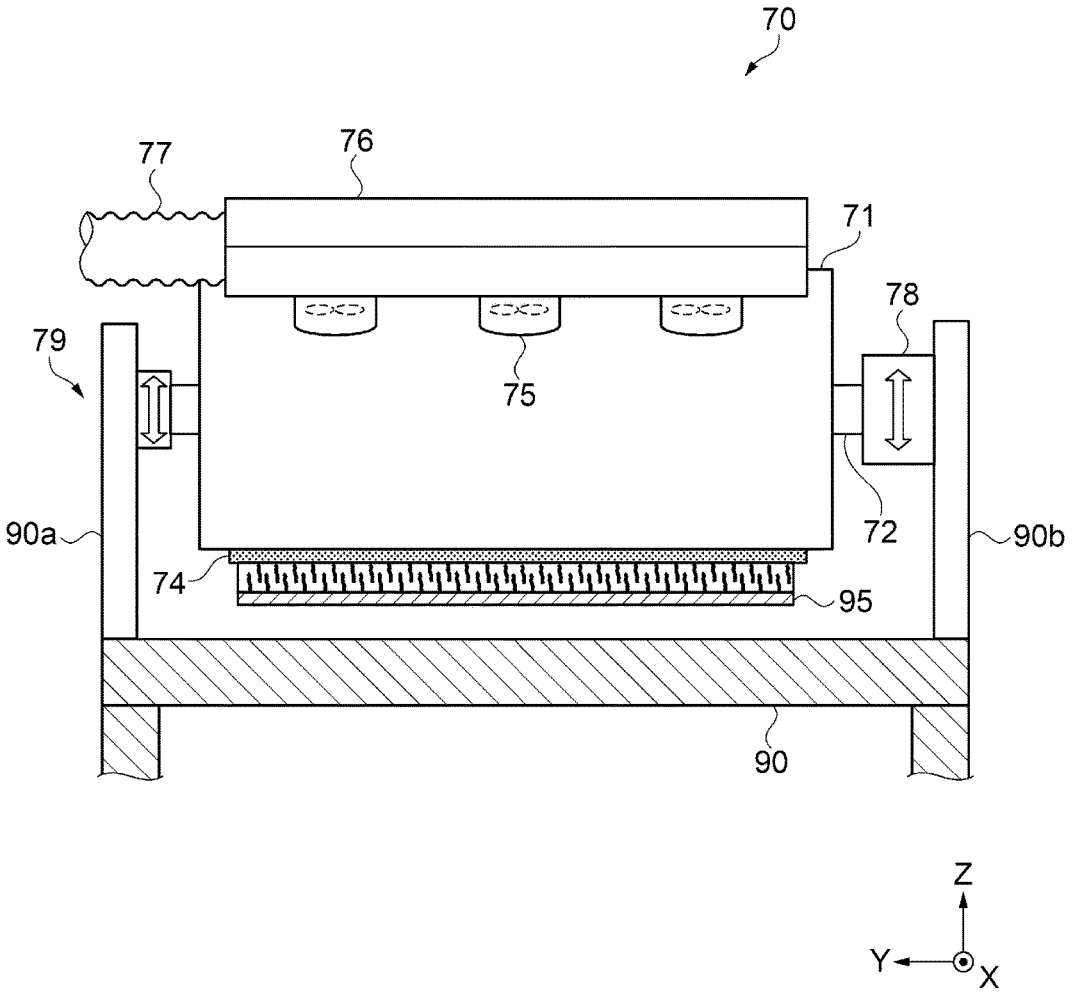
FIG. 3 is a side view illustrating configuration of the fluff cutter portion.

FIG. 2 is a sectional view illustrating configuration of an inside portion of a fluff cutter portion. FIG. 3 is a side view illustrating configuration of the fluff cutter portion. The fluff cutter portion 70 is provided on the upper side of the printing medium 95 which is transported in a state where a predetermined tension is applied between the transport roller 22 and the transport roller 23.

As illustrated in FIG. 2 and FIG. 3, the fluff cutter portion 70 includes a rotating blade 73 of which a rotating speed is changed, an outer blade 74 which is in contact with the rotating blade 73 and a fan 75.

The rotating blade 73 projects a plurality of flat blade-like cutting edges in a longer columnar shape than the width of the printing medium 95 and rotates about a rotating shaft 72. The rotating blade 73 is covered with a cylindrical cover 71. An opening portion 71*a* from which the cutting edge of the rotating blade 73 is exposed in a side facing the upper surface of the printing medium 95 is provided on the cover 71.

The outer blade 74 is provided on one end of a downstream side of the opening portion 71*a* of the cover 71 in the transport direction (+X axis direction) of the printing medium 95 and a cutting edge having a flat blade shape which is longer than the width of the printing medium 95 projects to an upstream side in parallel to the printing medium 95.

The rotating shaft 72 is supported to be rotatable between frame portions 90*a* and 90*b* which are erected on an outside of the printing medium 95 in a side view from the X-axis direction. The fluff cutter portion 70 includes a cutter driving motor 78 which rotates and drives the rotating shaft 72. The cutter driving motor 78 rotates the rotating blade 73 in a clockwise direction in FIG. 2. An operation of the cutter driving motor 78 is controlled by the control portion 1.

A cutter moving portion 79 as a moving unit which changes a distance between the fluff cutter portion 70 and the printing medium 95 is provided on at least one side of the frame portions 90*a* and 90*b*. The cutter moving portion 79 is a lifting device which lifts the fluff cutter portion 70. The cutter moving portion 79 includes a moving mechanism and a power source which are not illustrated. Mechanism of a combination of a ball screw and a ball nut, a linear guide mechanism, or the like can be adapted as a moving mechanism, for example. Further, a motor (not illustrated) as a power source for moving the fluff cutter portion 70 along Z axis direction is provided in the cutter moving portion 79. The motor may employ various motors such as a stepping motor, a servo motor, and a linear motor. The cutter moving portion 79 is controlled by the control portion 1.

As illustrated in FIG. 2, the printing medium 95 is configured with base fabric 95*a* and the fluff layer 95*b*. The fluff which is dense from the base fabric 95*a* is erected in the fluff layer 95*b* and the released fluff or long fluff projects. When the rotating blade 73 is rotated and the printing medium 95 is transported in the transport direction (+X axis direction), tip of fluff is cut in a predetermined height by being sandwiched in cutting edges of the rotating blade 73 and the outer blade 74. Accordingly, the printing medium 95 which includes the fluff layer 95*c* of which length is cut is transported to the printing portion 40 side.

The fluff cutter portion 70 includes the absorbing portion which absorbs the cut fluff. Specifically, a plurality of fans 75, as the absorbing portion, are provided on the upper side of the cover 71. The fans 75 include a motor (not illustrated) which drives the fans 75. When the fan 75 is driven, the cut fluff, the released fluff, or the like is absorbed and then is discharged to an outside of the cover 71. The fluff which is discharged from a plurality of fans 75 is collected to the collecting portion (not illustrated) via a gathering duct 76 to which plurality of fans 75 is connected and an exhaust air duct 77 which discharges to the outside of the printing apparatus 100.

Electrical Configuration

Figure 4:
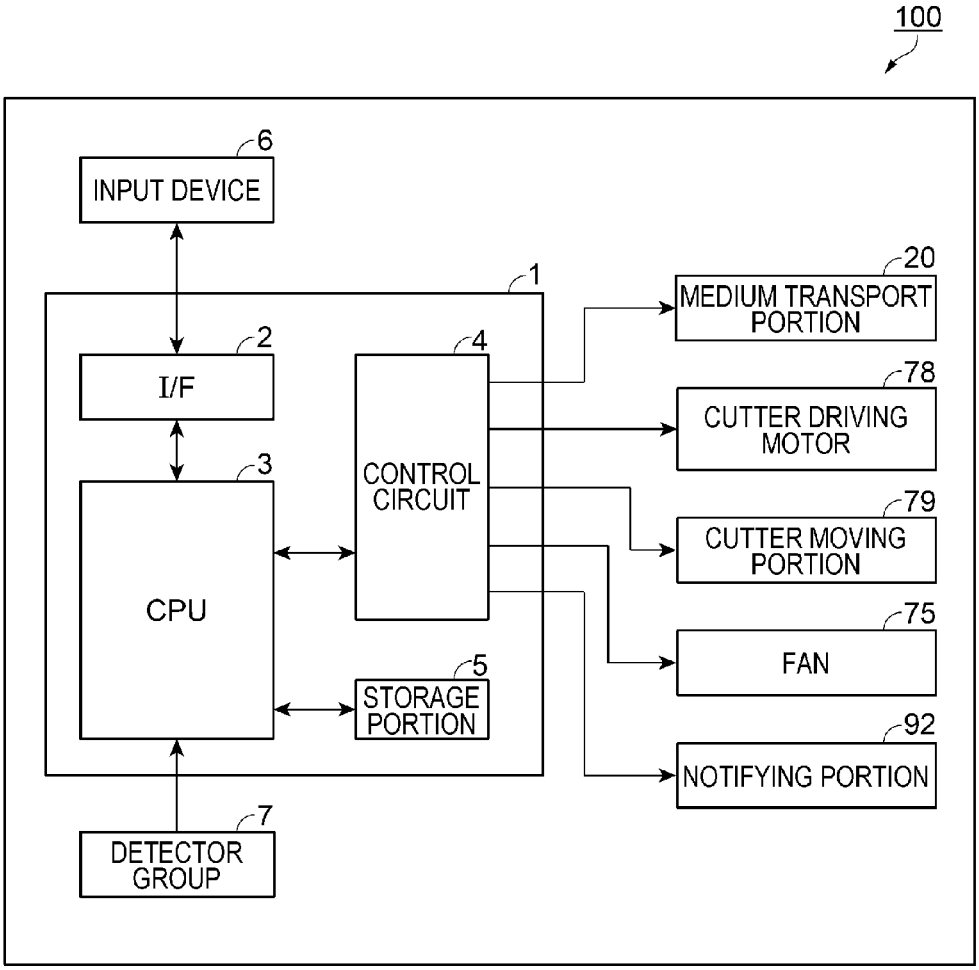
FIG. 4 is an electrical block diagram illustrating electric configuration of the printing apparatus.

FIG. 4 is an electrical block diagram illustrating electric configuration of the printing apparatus. Next, the electric configuration of the printing apparatus 100 will be described.

The printing apparatus 100 includes an input device 6 as an input unit which inputs various printing conditions, or the like and the control portion 1 which performs control of each portion of the printing apparatus 100. As the input device 6, Desktop or laptop personal computer (PC), tablet devices, portable devices, or the like can be used. The input device 6 may be provided separately from the printing apparatus 100.

The control portion 1 is configured to include a control circuit 4, an interface portion (I/F) 2, and a central processing unit (CPU) 3, and a storage portion 5. The interface portion 2 performs sending and receiving of data between the input device 6 which handles input signals and images and the control portion 1. The CPU 3 is an arithmetic processing device for performing input signal processing from various detector group 7 and control of entirety of the printing apparatus 100.

The storage portion 5 ensures area for storing of program of the CPU 3, working areas, or the like and includes a storage element such as a random access memory (RAM), and an electrically erasable programmable read-only memory (EEPROM). In addition, a rotating blade driving table to be described below is stored in the storage portion 5.

The control portion 1 outputs control signals from the control circuit 4 and controls driving of various motors included in the medium transport portion 20 and thus moves the printing medium 95 in the transport direction. The control portion 1 outputs control signals from the control circuit 4 and controls driving of the cutter driving motor 78 and thus rotates the rotating blade 73 of the fluff cutter portion 70. The control portion 1 outputs control signals from the control circuit 4 and controls driving of the motor which is provided on the cutter moving portion 79 and thus lifts the fluff cutter portion 70. The control portion 1 outputs control signals from the control circuit 4 and controls driving of the motor of the fan 75 and thus rotates the fan 75. The control portion 1 outputs control signals from the control circuit 4 according to the printing condition which is input to the input device 6 and thus notifies alarm to the notifying portion 92. In addition, the control portion 1 controls each device which is not illustrated.

Fluff Cutting Method

Figures 5, 6:
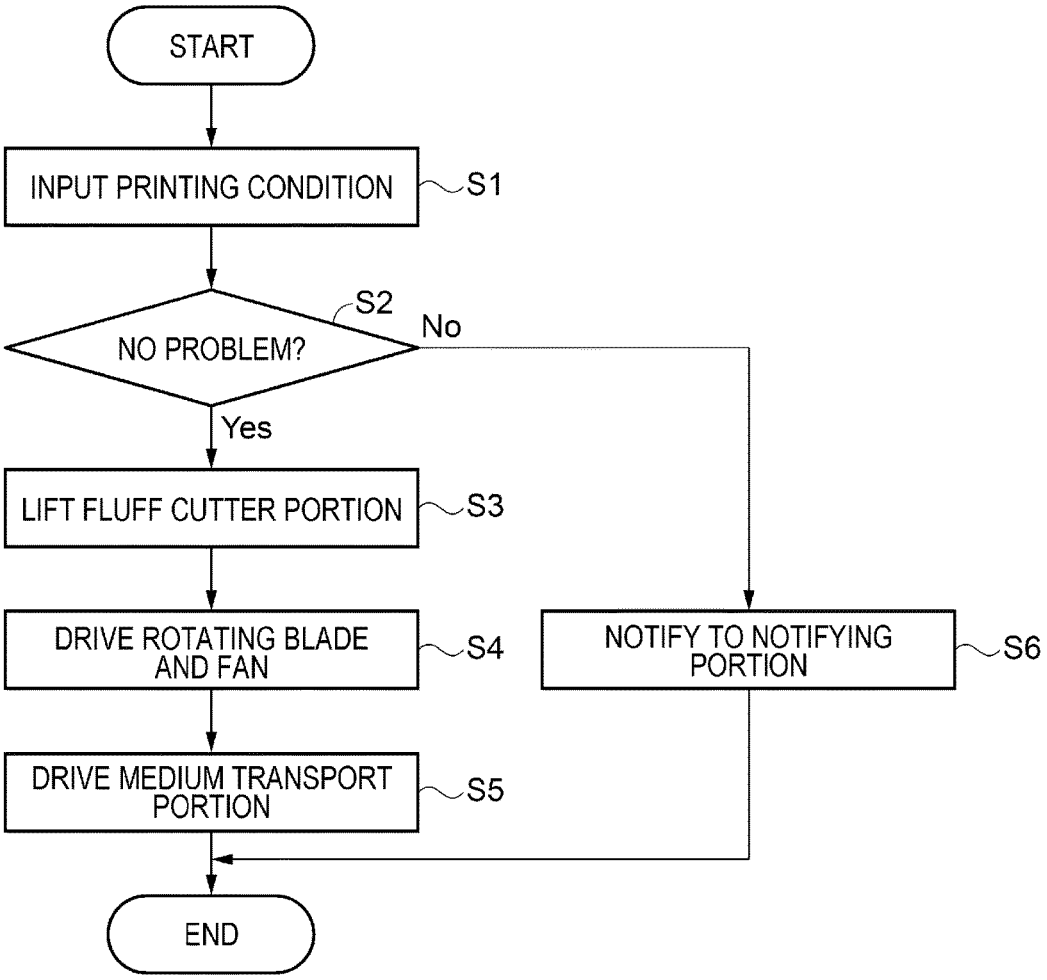
FIG. 5 is a flow chart explaining a method for cutting the fluff.
FIG. 6 is a rotating blade driving table illustrating driving amount of a rotating blade.

FIG. 5 is a flow chart explaining a method for cutting the fluff. FIG. 6 is a rotating blade driving table illustrating driving amount of a rotating blade.

Next, the fluff cutting method of the printing medium 95 will be described.

Input of the printing condition is performed in step S1. A user inputs the printing condition by the input device 6. As the printing condition, for example, there are a distance WG between the endless belt 48 and the discharging head 42 (hereinafter, referred to as gap WG) or the type of the printing medium 95.

Whether or not there is no problem on the input printing condition is determined in step S2. The control portion 1 determines where or not the input gap WG is suitable to the using printing medium 95. In a case where there is no problem in the printing condition (step S2: Yes), the process proceeds to step S3. In a case where there is problems in the printing condition (step S2: No), the process proceeds to step S6.

Lifting of the fluff cutter portion 70 is performed in step S3. The control portion 1 drives the cutter moving portion 79 and the fluff cutter portion 70 is lifted to a predetermined height with respect to the printing medium 95 according to the input gap WG.

The driving of the rotating blade 73 and the fan 75 is performed in step S4. The type of the printing medium 95 and the rotating speed which rotates the rotating blade 73 at the time of cutting the fluff of the printing medium 95 is indicated in the rotating blade driving table of FIG. 6. The control portion 1 refers to the rotating blade driving table stored in the storage portion 5 and determines the rotational speed of the rotating blade that corresponds to the type of input printing medium 95. For example, in a case where wool has been selected as the printing medium 95, the control portion 1 drives the cutter driving motor 78 and thus rotates the rotating blade 73 at a high speed. The control portion 1 can suitably cut the fluff of the fluff layer 95*b* of the printing medium 95 by changing the rotational speed of the rotating blade 73 according to the type of the printing medium 95.

In addition, the control portion 1 drives the fan 75 and thus generates air flow which flows from the opening portion 71*a* of the cover 71 to the fluff collecting portion via the gathering duct 76. Accordingly, the fluff which is cut by cutting of the fluff is prevented from being scattered in the inside of the printing apparatus 100.

The driving of the medium transport portion 20 is performed in step S5. The control portion 1 the printing medium 95 is moved in the transport direction by driving the medium transport portion 20. Accordingly, the printing medium 95 along the opening portion 71*a* of the fluff cutter portion 70 moves in the +X axis direction and the fluff layer 95*b* cuts in a predetermined height of the fluff layer 95*c*. The printing medium 95 of which fluff is cut is transported to the printing portion 40 and an image, or the like is printed on the printing medium 95. Since the predetermined height is set to be less than the gap WG, opportunity of contact between the discharging head 42 and the fluff layer 95*c* of the printing medium 95 with each other is reduced and thus Problems such as nozzle missing that the droplets are not discharged and landing deviation of the discharged droplets droplet are less likely to be generated. In addition, even if the printing medium 95 has a high fluff layer 95*b*, a clear image can be printed on the printing medium 95 since the gap WG can set to be lower than the height of the fluff layer 95*b*. Therefore, an image having excellent printing quality is formed on the printing medium 95 such as fabric.

Notification to the notifying portion 92 is performed in step S6. The control portion 1 notifies alarm to the notifying portion 92 according to the input printing condition. For example, the control portion 1 notifies a predetermined alarm to the notifying portion 92 in a case where the gap WG is less than the base fabric 95*a* of the printing medium 95 or in a case where the fluff layer 95*c* is extremely low after cutting of the fluff. Accordingly, damage of the texture of the printing medium 95 or performing of image quality reduced printing is prevented in advance.

As described above, according to the printing apparatus 100 related to the embodiment, the following effects can be obtained.

The printing apparatus 100 includes the fluff cutter portion 70 which cuts the fluff of the fluff layer 95*b* of the printing medium 95. The control portion 1 lifts the fluff cutter portion 70 to the predetermined height with respect to the printing medium 95 according to the distance (gap WG) between the endless belt 48 and the discharging head 42 which is input to the input device 6. Since the predetermined height is set to be less than the gap WG, opportunity of contact between the fluff layer 95*c* of the printing medium 95 of which the fluff is cut and the discharging head 42 with each other is reduced and thus Problems such as nozzle missing and landing deviation are less likely to be generated. In addition, even if the printing medium 95 has a high fluff layer 95*b*, a clear image can be printed on the printing medium 95 since the gap WG can set to be lower than the height of the fluff layer 95*b*. Therefore, an image having excellent printing quality can be formed on the printing medium 95 which has the fluff layer 95*b*. Therefore, the printing apparatus which improves the printing quality can be provided.

The fluff cutter portion 70 includes a rotating blade 73 of which a rotating speed is changed. Since the control portion 1 refers the rotating blade driving table, determines the rotating speed according to the type of the printing medium 95 and then drives the rotating blade 73, a different type of the printing medium 95 can be suitably cut the fluff.

The fluff cutter portion 70 includes the fan 75 which absorbs the cut fluff. Since the control portion 1 drives the fan 75 and an air flow which flows from the opening portion 71*a* of the cover 71 to the fluff collecting portion is generated, the fluff cut by cutting of the fluff is prevented from being scattered in the inside portion of the printing apparatus 100.

The printing apparatus 100 includes a notifying portion 92 which notifies an alarm according to the input printing condition. Since the control portion 1 notifies the predetermined alarm to the notifying portion 92 in a case where the gap WG is unsuitable, or the like, damage of texture of the printing medium 95 performing of image quality reduced printing can be prevented in advance.

Embodiment 2

Figure 7:
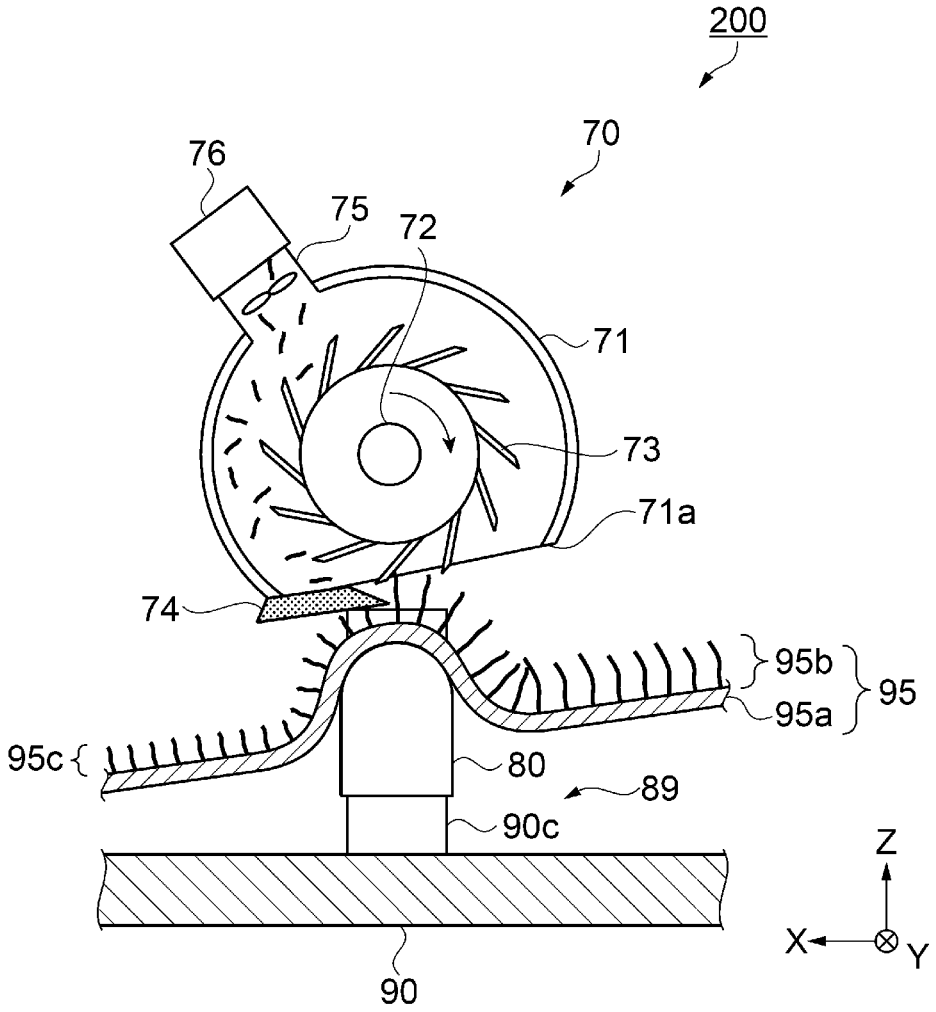
FIG. 7 is a sectional view illustrating a fluff cutter portion and a projecting portion according to Embodiment 2.
Figure 8:
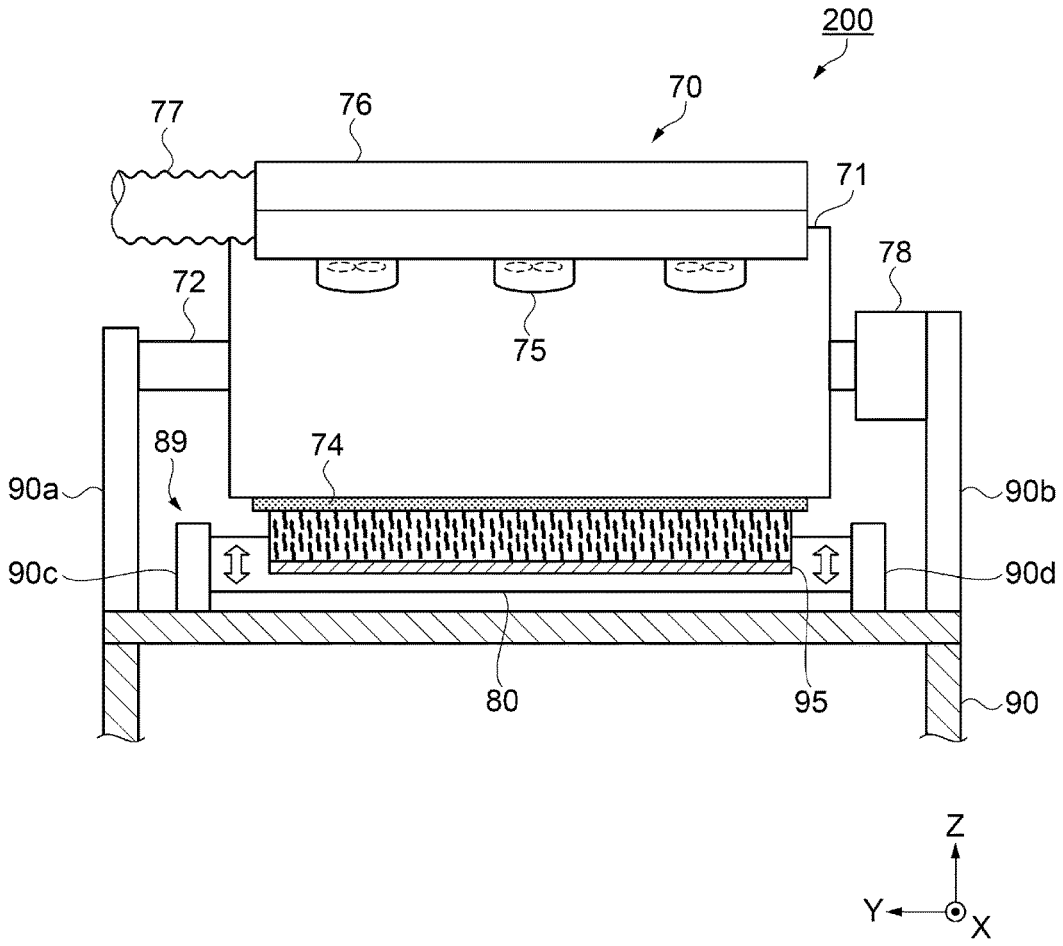
FIG. 8 is a side view illustrating configuration of the fluff cutter portion and the projecting portion.

FIG. 7 is a sectional view illustrating configuration of a fluff cutter portion and a projecting portion according to Embodiment 2. FIG. 8 is a side view illustrating configuration of the fluff cutter portion and the projecting portion. Next, with reference to FIG. 7 and FIG. 8, a printing apparatus 200 of the embodiment will be described. For the same components as in Embodiment 1, the same number is used, and a duplicate description thereof will be omitted.

As illustrated in FIG. 7 and FIG. 8, the printing apparatus 200 includes a projecting portion 80 which lifts the printing medium 95 to a position facing the fluff cutter portion 70. The projecting portion 80 has a plate-like rectangular parallelepiped which is longer than the width of the printing medium 95 in a side view from X axis direction and a top surface (surface of +Z-axis side) of a rectangular parallelepiped is chamfered in an arc shape in a side view from the Y axis direction. The printing medium 95 which is transported in the transport direction is curved upward following an arc shape of the projecting portion 80 and the fluff of fluff layer 95*b* is generated at the vertex of the arc. The fluff cutter portion 70 is provided on a position in which the rotating blade 73 and the outer blade 74 are in contact with each other at the upper side of the vortex of the projecting portion 80.

The projecting portion 80 is supported between frame portions 90*c* and 90*d* which are erected on an outside of the printing medium 95 in a side view from the X-axis direction. A projection moving portion 89 as a moving unit which changes a distance between the fluff cutter portion 70 and the printing medium 95 is provided on at least one side of the frame portions 90*c* and 90*d*. The projection moving portion 89 is a lifting device which lifts the projecting portion 80 and changes a distance between the printing medium 95 on the projecting portion 80 and the fluff cutter portion 70. The projection moving portion 89 includes a moving mechanism and a power source which are not illustrated. Mechanism of a combination of a ball screw and a ball nut, a linear guide mechanism, or the like can be adapted as a mechanism of the moving mechanism. Further, a motor (not illustrated) as a power source for moving the projecting portion 80 along Z axis direction is provided in the projection moving portion 89. The motor may employ various motors such as a stepping motor, a servo motor, and a linear motor.

The control portion 1 drives the projection moving portion 89 and the projecting portion 80 is lifted corresponding to the input gap WG and thus the printing medium 95 on the projecting portion 80 is positioned to a predetermined height with respect to the fluff cutter portion 70. Accordingly, the fluff layer 95*b* is cut in a predetermined height of fluff layer 95*c* since the control portion 1 drives the cutter driving motor 78 and the medium transport portion 20 and then moves the printing medium 95 in the transport direction. The fluff cutter portion 70 can be suitably cut the fluff layer 95*b* since the printing medium 95 is lifted to the upper side by the projecting portion 80. In addition, since the predetermined height is set to be less than the gap WG, opportunity of contact between the fluff layer 95*c* of the printing medium 95 of which the fluff is cut and the discharging head 42 with each other is reduced and thus Problems such as nozzle missing in which droplets are not discharged and landing deviation of discharged droplets are less likely to be generated.

As described above, according to the printing apparatus 200 related to the embodiment, the following effects can be obtained.

The printing apparatus 200 includes a projecting portion 80 which lifts the printing medium 95 to a position facing the fluff cutter portion 70. The control portion 1 lifts the projecting portion 80 and positions the printing medium 95 on the projecting portion 80 to a predetermined height with respect to the fluff cutter portion 70 according to the distance (gap WG) between the endless belt 48 and the discharging head 42 which is input to the input device 6. Since the predetermined height is set to be less than the gap WG, opportunity of contact between the fluff layer 95*c* of the printing medium 95 of which the fluff is cut and the discharging head 42 with each other is reduced and thus Problems such as nozzle missing and landing deviation are less likely to be generated. In addition, even if the printing medium 95 has a high fluff layer 95*b*, a clear image can be printed on the printing medium 95 since the gap WG can set to be lower. Therefore, an image having excellent printing quality can be formed on the printing medium 95 which has the fluff layer 95*b*. Therefore, the printing apparatus which improves the printing quality can be provided. In addition, the fluff layer 95*b* can be suitably cut since the printing medium 95 is lifted to the upper side by the projecting portion 80.

This application claims priority under 35 U.S.C. § 119 to Japanese Patent Application No. 2016-002313, filed Jan. 8, 2016. The entire disclosure of Japanese Patent Application No. 2016-002313 is hereby incorporated herein by reference.

What is claimed is:

1. A printing apparatus, comprising:

a discharging head which discharges liquid on a printing medium mounted on an endless belt;

a transport unit which transports the printing medium in a transport direction;

an input unit to which a printing condition is input; and a fluff cutter portion which is provided on an upstream side of the discharging head in the transport direction and which cuts fluff of the printing medium in a predetermined height according to the printing condition, wherein the fluff cutter portion does not penetrate the printing medium.

2. The printing apparatus according to claim 1, wherein the printing condition includes a distance between the endless belt and the discharging head, the printing apparatus further comprising:

a moving unit which changes a distance between the fluff cutter portion and the printing medium according to the distance.

3. The printing apparatus according to claim 1, wherein the printing condition includes a type of the printing medium, and the fluff cutter portion includes a rotating blade of which a rotational speed is changed according to the type.

4. The printing apparatus according to claim 1, wherein the fluff cutter portion includes an absorbing portion which absorbs the cut fluff.

5. The printing apparatus according to claim 1, further comprising:

a projecting portion which lifts the printing medium to a position facing the fluff cutter portion.

6. The printing apparatus according to claim 1, further comprising:

a notifying portion which notifies an alarm according to the input printing condition.

* * * * *